United States Patent [19]

Castillo et al.

[11] 4,297,939

[45] Nov. 3, 1981

[54] AMMUNITION FEEDER

[75] Inventors: Tomas R. Castillo, Fountain Valley; Arthur L. Gardiner, Tustin, both of Calif.

[73] Assignee: The United States of America as represented by the Secretary of the Army, Washington, D.C.

[21] Appl. No.: 47,596

[22] Filed: Jun. 8, 1979

[51] Int. Cl.[3] ..... F41D 10/08

[52] U.S. Cl. ..... 89/33 L; 89/33 SF

[58] Field of Search ..... 89/33 R, 33 SF, 33 BB, 89/33 C

[56] References Cited

U.S. PATENT DOCUMENTS 2,383,780 8/1945 Dobremysl ..... 89/33 C 3,630,118 12/1971 Stoner ..... 89/33 SF

FOREIGN PATENT DOCUMENTS 130112 7/1919 United Kingdom ..... 89/33 C

*Primary Examiner*—Stephen C. Bentley

*Attorney, Agent, or Firm*—Peter A. Taucher; John E. McRae; Nathan Edelberg

[57] ABSTRACT

A recoil-operated gas assisted gun having a linked ammunition feeder means and a link guide housing arranged so that the links are separated from individual rounds of ammunition as said rounds are introduced into the gun chamber. The link guide housing contains three sets of deflectable pawls that project into the chute defined by the housing. As the linked ammunition is fed upwardly through the chute the pawls snap into positions underlying the links for the three uppermost ammunition rounds; the pawls collectively bear the weight of the linked ammunition system, thereby accurately positioning the uppermost ammunition round and avoiding possible jamming due to variations or changes of the linked components as the length of the link system lessens. A retractor plate is slidably positioned on an outer face of the link guide housing for moving the pawls out of registry with the ammunition rounds, e.g. when it is necessary to download ammunition out of the chute.

1 Claim, 5 Drawing Figures

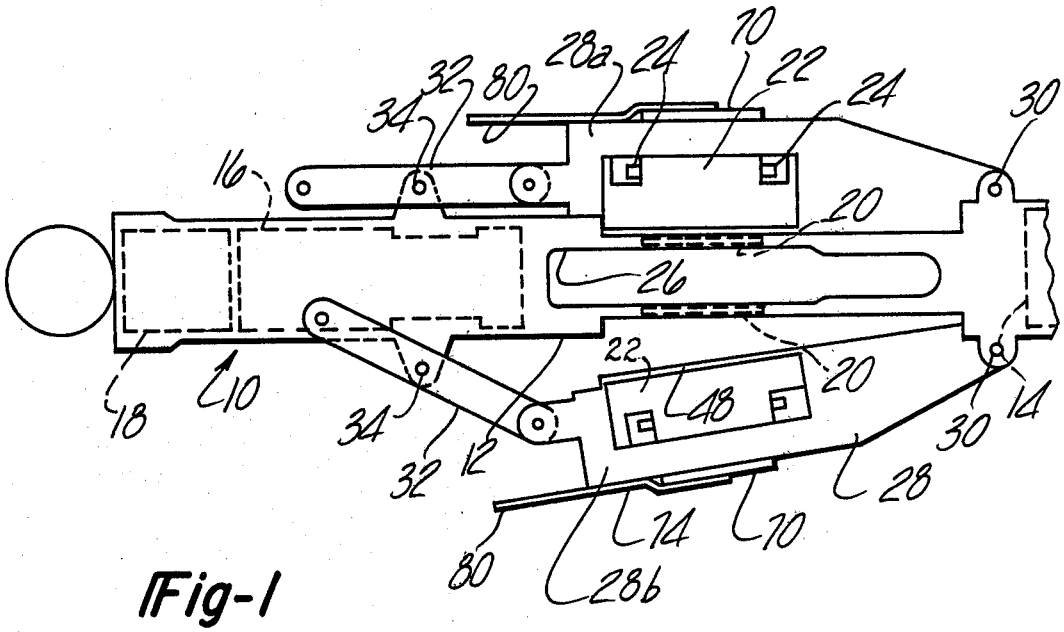
Fig-1
Fig-2
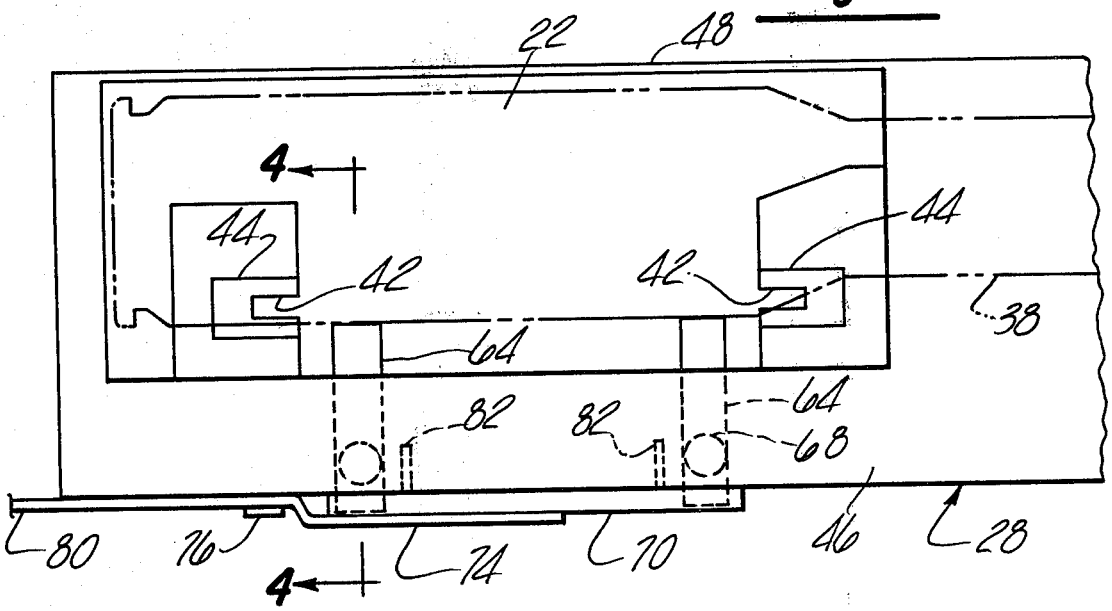

AMMUNITION FEEDER

The invention described herein may be manufactured, used, and licensed by or for the Government for governmental purposes without payment to us of any royalty thereon.

BACKGROUND AND SUMMARY OF THE INVENTION

This invention relates to a mechanism usable in the gun feeder system shown in U.S. Pat. No. 3,630,118 issued on Dec. 28, 1971 to E. M. Stoner. The added mechanism consists of a number of deflectable pawls at one edge of a feeder chute for temporarily bearing the weight of the linked ammunition prior to entry of the individual ammunition rounds into the gun; the objective is to prevent variations in weight of the linked system from stretching the resilient links and thereby producing inaccuracies in the location of the ammunition rounds. A second mechanism is provided for retracting the pawls when it is necessary to download the linked ammunition out of the chute, e.g. at the end of a firing period or after a gun malfunction.

THE DRAWINGS

FIG. 1 is a fragmentary top plan view of a gun-feeder assembly utilizing the invention.

FIG. 2 is an enlarged view of a portion of the structure shown in FIG. 1.

Figure 3:
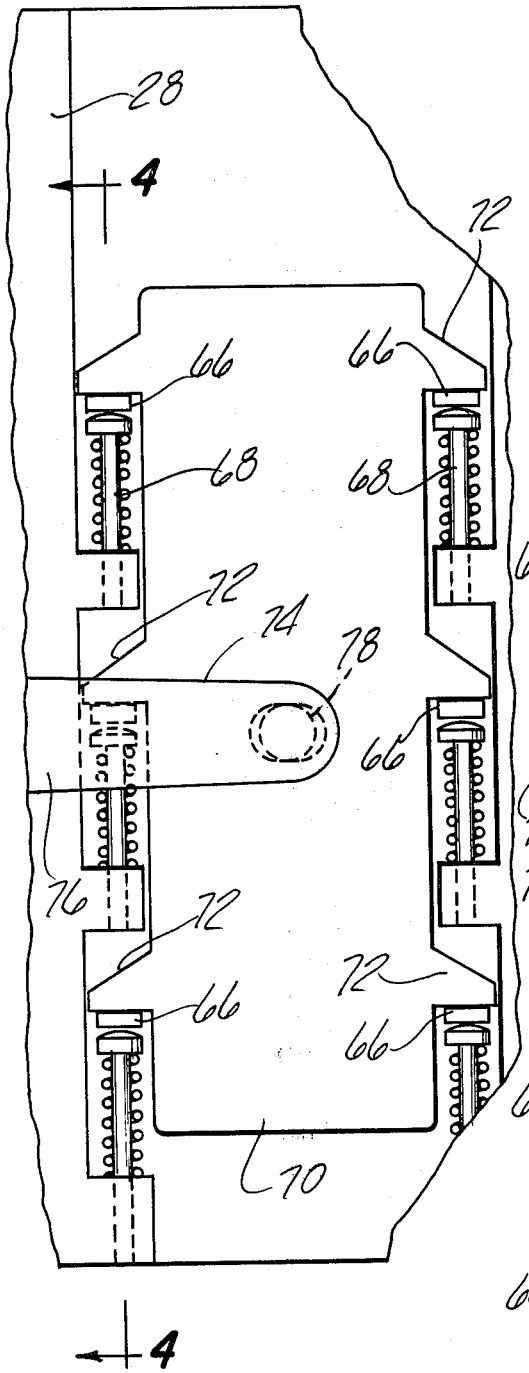
FIG. 3 is a side elevational view of the FIG. 2 structure.

Referring more particularly to FIG. 1, there is fragmentarily shown a recoil-operated gas assisted gun 10 of the type shown in U.S. Pat. No. 3,630,118. The receiver or stationary portion 12 of the gun slidably supports a gun barrel 14 that extends rightwardly beyond FIG. 1. A bolt carrier 16 reciprocates back and forth in the space between barrel 14 and a resilient buffer 18 located at the rear end of the receiver. Gas pressure generated in the barrel drives carrier 16 in the recoil direction to the left or rear; buffer 18 receives the impact force of the bolt carrier and drives the carrier in a counter recoil direction to the right (or forwardly). The operation is as described in U.S. Pat. No. 3,630,118.

Bolt carrier 16 includes non-illustrated cam surfaces that produce vertical movements of two ammunition feeder plates 20 that are slidably positioned in the side walls of the receiver. During leftward movement of the bolt carrier in the recoil direction one of the feeder plates 20 is moved upwardly to move linked ammunition upwardly through an associated feeder chute 22 into a space alongside the return path of bolt carrier 16. As the bolt carrier assembly moves forwardly in the counter recoil direction it impacts the uppermost ammunition round and delivers it into gun barrel 14 for firing. The vacant ammunition links are guided upwardly out of chutes 22 by slotted vertical guides 24 that extend upwardly from the chutes. During leftward movement of the bolt carrier in the recoil direction a spent cartridge is ejected upwardly through an opening 26 in the top wall of receiver 12.

The illustrated gun system includes duplicate mechanisms for feeding ammunition into the gun from two different supply sources. Each feeder mechanism includes one of the aforementioned feeder plates 20, together with an associated ammunition link guide housing 28; each housing 28 is internally configured to define a feeder chute 22. Each housing is swingably attached at 30 to receiver 12. The rear end of each housing 28 is linked to a crank 32 that is swingably mounted on receiver 12 by means of a pivot 34. Manual or motor force applied to the rear end of crank 32 shifts the associated housing 28 between an ammunition upfeed operative position **28*a* swung toward the receiver and a downloader non-use position 28*b*** swung away from the receiver.

Figure 4:
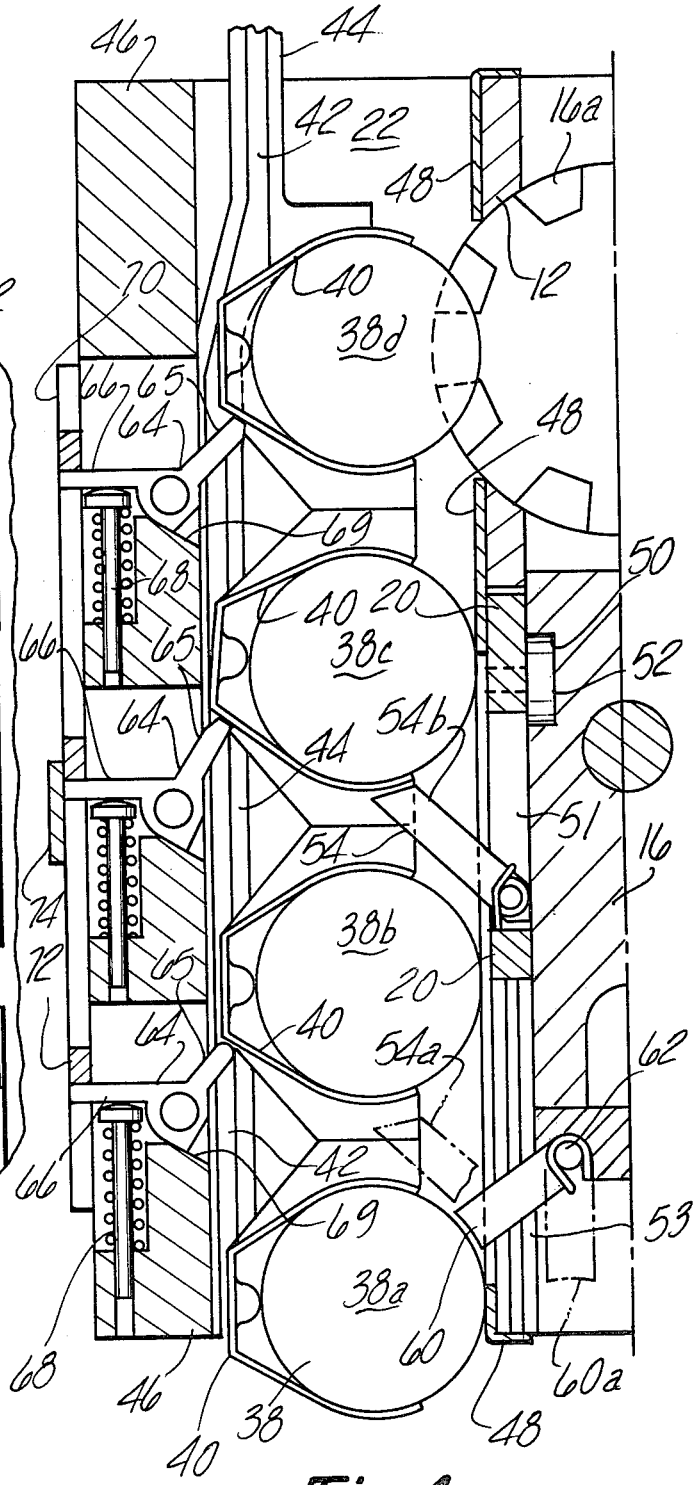
FIG. 4 is a sectional view taken on lines 4—4 in FIGS. 2 and 3.

The internal structure of each housing 28 is best visualized from FIG. 4. Individual rounds of ammunition 38 are carried in resilient links 40 whose lateral edges extend into guide slots 42 in spaced upstanding guide bars 44 suitably affixed to outer wall 46 of link guide housing 28; the spacing of bars 44 is best visualized in FIG. 2. When housing 28 is in its upfeed position **28*a* its inner wall 48 abuts against the side surface of receiver 12; the space between housing walls 48 and 46 constitutes the aforementioned chute 22. Ammunition upfeed force is provided by movement of bolt carrier 16 in the recoil direction (normal to the plane of the paper in FIG. 4). A cam slot 50 in the bolt carrier tracks on a roller 52 carried by feeder plate 20 that is guided for vertical movement in an opening 53 in receiver 12. Plate 20 mounts two laterally-spaced spring-urged pawls 54 that can swing between extended positions projecting into chute 22 and retracted positions within slots 51 in plate 20; only one of the pawls 54 is shown in FIG. 4. When plate 20 is at the upper limit of its stroke pawls 54 assume the full line position 54*b*; when plate 20 is at the lower limit of its travel the pawls assume the dotted line position 54*a*. On each upstroke of plate 20 the pawls advance the linked ammunition upwardly through a single round-to-round spacing distance; i.e. one round advances from station 38*a* to station 38*b*, another round advances from station 38*b* to 38*c*, and so forth. The upward advance is limited by a spring-urged pawl 60 swingably mounted at 62 on receiver 12. During the next downstroke of plate 20 the inner surface of the plate deflects pawl 60 to a retracted position 60*a* out of the path taken by the linked ammunition system; therefore pawl 54 is enabled to effect another upward advance of the ammunition without interference from pawl 60**. The upfeed system is generally similar to that shown in U.S. Pat. No. 3,630,118.

The present invention concerns an additional mechanism to be used in each link guide housing 28 for insuring improved positionment of the linked ammunition as it is conveyed upwardly through the defined chute 22. The positionment mechanism comprises six spring-urged pawls 64 individually pivotably mounted at three different levels on housing outer wall 46; only three of these pawls are visible in FIG. 4. Each pawl includes a first support arm 65 arranged to supportably engage the undersurface area of an ammunition link, and a second arm 66 extending beyond the outboard face of housing wall 46; arm 65 is sometimes referred to as an actuator arm because its function is to actuate the pawl to a retracted position out of the path taken by the linked ammunition. Each pawl is biased in a clockwise direction (FIG. 4) by means of a spring-urged pin 68; a stop surface on the pawl lower edge abuts against shoulder 69 formed on housing wall 46, thereby limiting movement of the pawl in the clockwise direction.

When pawls 64 are in the FIG. 4 positions they individually support significant portions of the weights of the associated ammunition rounds; the result is improved control on the positionment of individual rounds in chute 22. It is noted that the pitch distance of the ammunition rounds (i.e. spacing from one round centerline to the next round centerline) is not always the same. The pitch distance can vary or change due to several factors, including manufacturing tolerances on links 40, the weight of the linked ammunition system, the unsupported length of the ammunition belt below chute 22, and the frictional conditions within chute 22. Each link 40 is manufactured with a resilient characteristic so that tolerances and other factors can cause undesired link stretch or separation. Pawls 64 are preferably dimensioned so that the two uppermost pawls 64 support a significant portion of the weight of the ammunition round in station 38*d*, the two intermediate pawls 64 support a significant portion of the weight of the ammunition round in station 38*c*, and the two lowermost pawls 64 support a significant portion of the weight of the ammunition round in station 38*b*.

During each upstroke of feeder plate 20 the feeder pawls 54 impart high upward acceleration forces onto the linked ammunition system. As feeder plate 20 comes to a stop at the upper limit of its stroke the linked ammunition may become slightly airborne until limited by the anti-surge pawls 60. Thereafter the linked rounds settle slightly so that pawls 64 act as support mechanisms for individual ammunition rounds. Preferably arm 65 for each of the two lowermost pawls 64 is slightly shorter than the corresponding arm 65 for each of the intermediate pawls 64. Similarly, arms 65 for the intermediate pawls are slightly shorter than the arms 65 for the two uppermost pawls 64. Due to this arrangement each pawl supports part of the weight of the linked ammunition system. As a result, the uppermost ammunition round is accurately located in station 38*d* for jam-free motion into the gun by impact with the oncoming bolt 16*a* (FIG. 4). Pawls 64 accurately position and support the ammunition rounds, while preventing link stretch or buckle.

Figure 5:
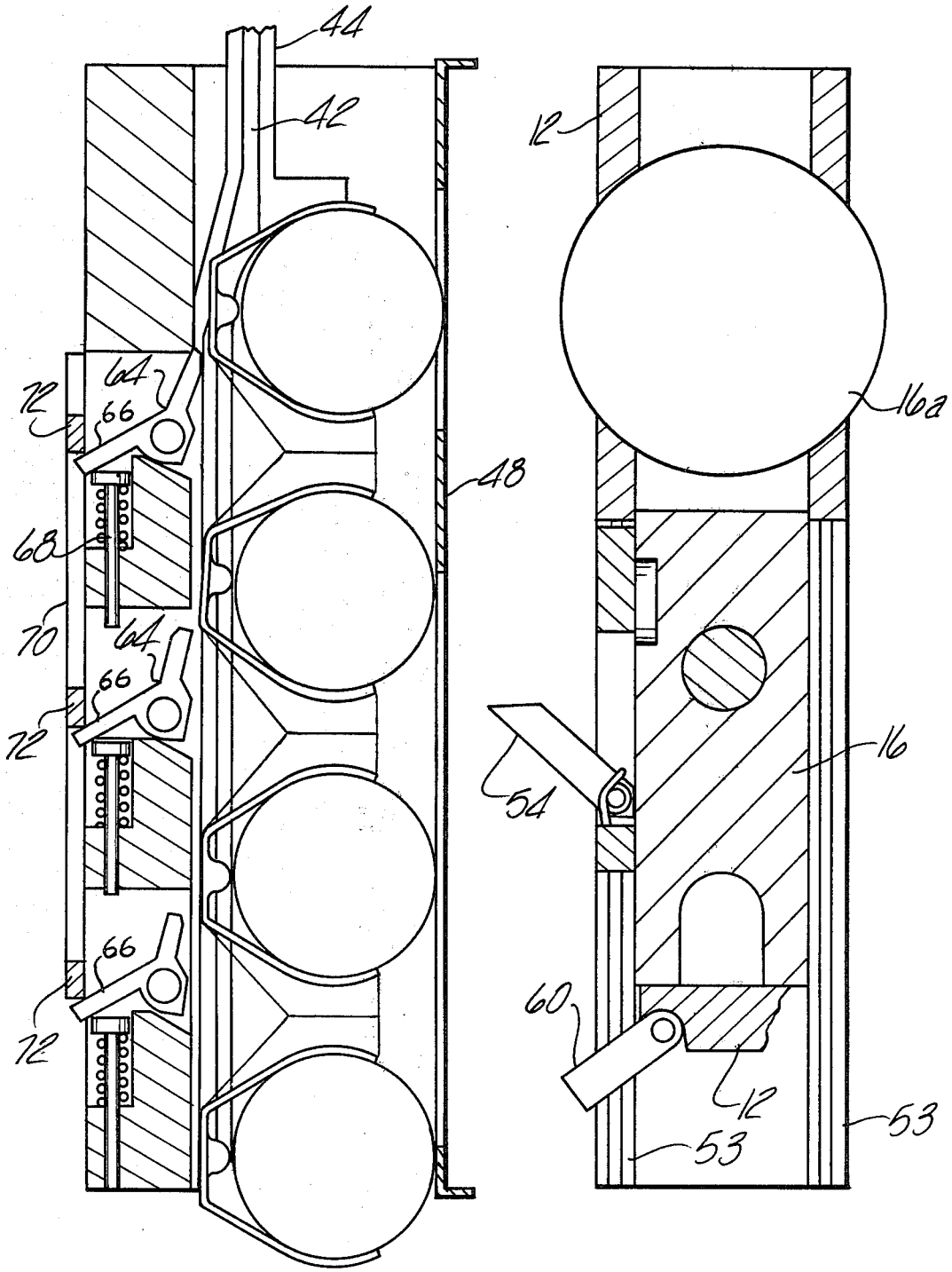
FIG. 5 is a view similar to FIG. 4 but showing certain mechanisms in a different condition of adjustment.

At the end of a firing cycle, or in the event of gun malfunction, it is necessary that the linked ammunition be withdrawn downwardly through chute 22 to clear the feeder mechanism. With the components in the FIG. 4 position pawls 64 and 54 prevent downward movement of the ammunition. However, if the link guide housing 28 is swung outwardly to position 28*b* (FIG. 1) the ammunition is then clear of pawls 54; this condition can be visualized from FIG. 5. Pawls 64 can be retracted out of the path of the ammunition by means of a slidable plate 70 positioned on the outer surface of housing wall 46. The plate includes arms or wings 72 that overlie individual ones of the actuator arms 66 to exert thrust forces thereon. Downward movement of the plate moves the individual pawls 64 to the FIG. 5 retracted positions out of the path taken by the linked ammunition. A lever-like handle 74, pivotally mounted at 76 on housing 28, has a pin-slot connection 78 with plate 70, whereby an upward manual pull on the handle free end 80 produces a downward motion of plate 70. The plate may be guided by means of slotted tabs 82 (FIG. 2) extending into slots in housing 28. When manual pressure is released from handle 74 the spring-urged pins return pawls 64 and plate 70 to the FIG. 4 position.

Each pawl 64 is constructed so that its arm 65 extends upwardly at an acute angle to the axis of chute 22 when the pawl is in its FIG. 4 position projecting into the path taken by the ammunition. While each pawl is being moved from the FIG. 4 position to the FIG. 5 position the upper end of arm 65 slides tangentially along the undersurface of the ammunition link 40 without exerting any substantial force thereon. Should the linked ammunition be jammed in chute 22 it is possible to retract pawls 64 to the FIG. 5 positions without interference from the jammed ammunition.

We wish it to be understood that we do not desire to be limited to the exact details of construction shown and described for obvious modifications will occur to a person skilled in the art.

We claim:

1. In combination, a recoil-operated gas assisted gun having a linked ammunition feeder means (20) arranged thereon for movement normal to the gun axis; an ammunition-link guide housing (28) swingably mounted on the gun for movement from a downloader position to an upfeed position; three sets of deflectable spring-urged pawls (64) carried within the link guide housing in vertically-spaced relationship to each other for supportably engaging undersurface areas of adjacent ammunition links, thereby accurately positioning the supported ammunition rounds; said spring-urged pawls including an upper set of pawls, an intermediate set of pawls, and a lower set of pawls; the pawls being dimensioned so that the upper set of pawls supports a significant portion of the weight of the uppermost ammunition round, the intermediate sets of pawls supports a significant portion of the weight of the intermediate ammunition round, and the lower set of pawls supports the weight of the remaining rounds in the linked ammunition system; each pawl having a stop surface thereon normally abutting against an internal shoulder (69) on the link guide housing, whereby at least a portion of the weight of the associated ammunition round is transmitted to the guide housing; each pawl having an actuator arm (66) extending beyond an outboard face of the link guide housing; a manually-actuatable plate (70) slidably arranged on the outboard face of the link guide housing for vertical movement in a plane parallel to a plane passing through the pivot axes of the swingable pawls; said plate having thrust surfaces (at 72) engageable with the pawl actuator arms, whereby plate movement in the downward direction causes the pawls to be pivoted outwardly to positions disengaged from the ammunition links, so that the linked ammunition can be downloaded out of the link guide housing.

* * * * *